US007534118B2

(12) United States Patent
Cheng et al.

(10) Patent No.: US 7,534,118 B2
(45) Date of Patent: May 19, 2009

(54) ELECTRICAL CARD CONNECTOR

(75) Inventors: Yung-Chang Cheng, Tu-Cheng (TW); Zhi-Feng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/072,185

(22) Filed: Feb. 25, 2008

(65) Prior Publication Data

US 2008/0207012 A1 Aug. 28, 2008

(30) Foreign Application Priority Data

Feb. 26, 2007 (TW) ..... 96203303 U

(51) Int. Cl.
*H01R 13/62* (2006.01)

(52) U.S. Cl. ..... 439/159

(58) Field of Classification Search ..... 439/607, 439/630, 159

See application file for complete search history.

(56) References Cited

U.S. PATENT DOCUMENTS

| | | | | |
|---|---|---|---|---|
| 6,109,941 | A * | 8/2000 | Koseki et al. | 439/159 |
| 6,508,670 | B1 * | 1/2003 | Hwang | 439/607 |
| 7,101,227 | B2 | 9/2006 | Kuo | |
| 7,150,650 | B2 | 12/2006 | Kuo | |
| 7,189,087 | B2 * | 3/2007 | Taguchi | 439/159 |
| 2005/0287870 | A1 * | 12/2005 | Kuo | 439/630 |
| 2007/0141879 | A1 * | 6/2007 | Wu | 439/159 |
| 2007/0218727 | A1 * | 9/2007 | Ting et al. | 439/159 |

* cited by examiner

*Primary Examiner*—Tho D Ta
(74) *Attorney, Agent, or Firm*—Wei Te Chung

(57) ABSTRACT

An electrical card connector includes a shell (1) structured as L-shaped, an insulating housing (2) covered by the shell, a plurality of terminals (3) retained in the insulating housing, a triangular guiding plate (4) placed in the card room for guiding a card insertion, and a bottom plate (7) confirming in shape with the shell placed under the bottom plate. The shell has a shorter side wall (13) and a longer side wall (12) opposite to the shorter side wall, a card room defined by the shell for receiving a card. The guiding plate locks with the bottom plate, therefore, the guiding plate and the bottom plate are locked with each other more firmly.

8 Claims, 5 Drawing Sheets

ELECTRICAL CARD CONNECTOR

BACKGROUND OF THE INVENTION

1. Field of the Invention

The present invention relates to a structure of a card connector used for memory cards for use in various portable information terminals, such as a portable telephone or a PC, or memory support equipments such as a digital camera or a digital AV equipment.

2. Description of Prior Arts

A card connector is generally used as an expanded recording apparatus of an electronic equipment such as a personal computer or a digital camera. As a storage medium of the card connector, a PC card or a memory card has come into wide use.

This PC card or memory card is installed in the card connector to write and read necessary information. An express card, for example, has two types different in width. One is I-shaped and the other is L-shaped. Accordingly, an L-shaped express card connector with an L-shaped receiving room turns up for selectively receiving the I-shaped or the L-shaped card. However, the I-shaped card may be fall off from the L-shaped receiving room, because the I-shaped card is narrower than the L-shaped card and only one side ruler formed on the L-shaped card connector can guide insertion of the card.

To solve the problem as described above, an express card connector with a metal plate mounted on the bottom thereof is appeared in recent years. U.S. Pat. No. 7,150,650, for example, discloses a card connector having a bottom plate to prevent an inserted card from falling off the card connector, and an ejecting mechanism mounted on one lateral side thereof for pushing the inserted card out. The bottom plate is mounted in a manner that a plurality of stabbing pieces formed on the opposite side edges thereof mate with corresponding locking holes on a shell of the card connector. Particularly, the ejecting mechanism is placed on a lateral side of the shell in the same way as the bottom plate described above. In this case, the ejecting mechanism and the bottom plate may interfere each other because of a limited room on the shell. When the ejecting mechanism is operated, the bottom plate may shake and tends to become loose. So, it is an object of the present invention to solve the above described problem.

SUMMARY OF THE INVENTION

An object, therefore, of the invention is to provide a card connector having a bottom plate firmly retained thereon.

In the exemplary embodiment of the invention, an electrical card connector includes a shell structured as L-shaped, an insulating housing covered by the shell, a plurality of terminals retained in the insulating housing, a triangular guiding plate placed in the card room for guiding a card insertion, and a bottom plate confirming in shape with the shell placed under the bottom plate. The shell has a shorter side wall and a longer side wall opposite to the shorter side wall, a card room defined by the shell for receiving a card. The guiding plate locks with the bottom plate, therefore, the guiding plate and the bottom plate are locked with each other more firmly.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
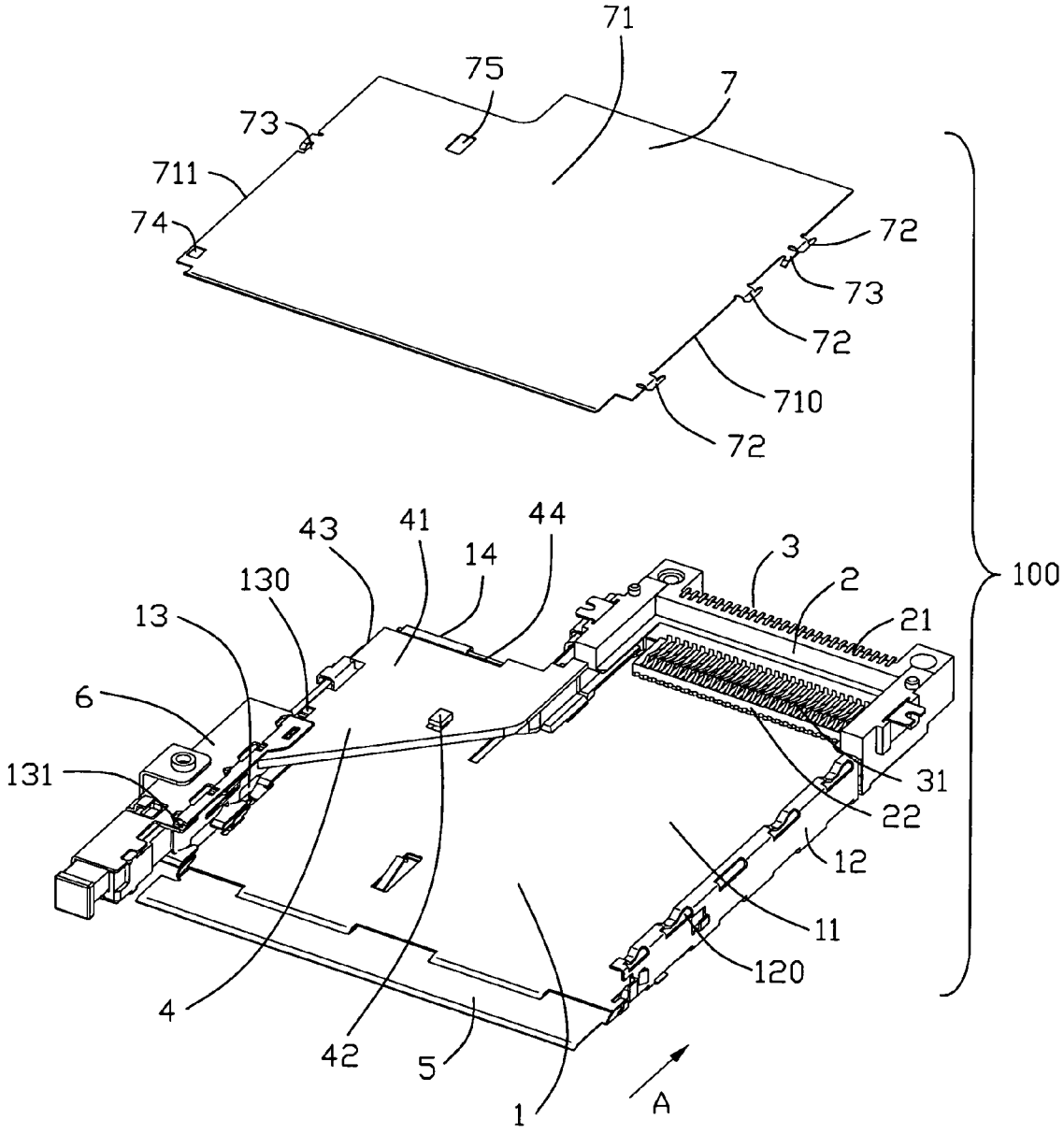
FIG. 1 is a perspective, assembly view of an electrical card connector in accordance with the present invention.

Referring to FIG. 1 to FIG. 5, a description will be made of an electrical card connector 100 (hereinafter simply be referred to as a "connector") according to an embodiment of this invention. The connector is capable of selectively receiving two kinds of cards with different width.

The connector 100 comprises a metal shell 1, an insulating housing 2 covered by the shell 1, a plurality of terminals 3 retained in the insulating housing 2, a guiding plate 4 disposed in a space defined by the shell 1, an expanding plate 5 placed at the front end of the shell 1, an ejecting mechanism 6 mounted at one lateral side of the shell 1 and a bottom plate 7 located under the shell 1.

The elements of the connector as mentioned above will be described detailedly in following segments.

Figure 2:
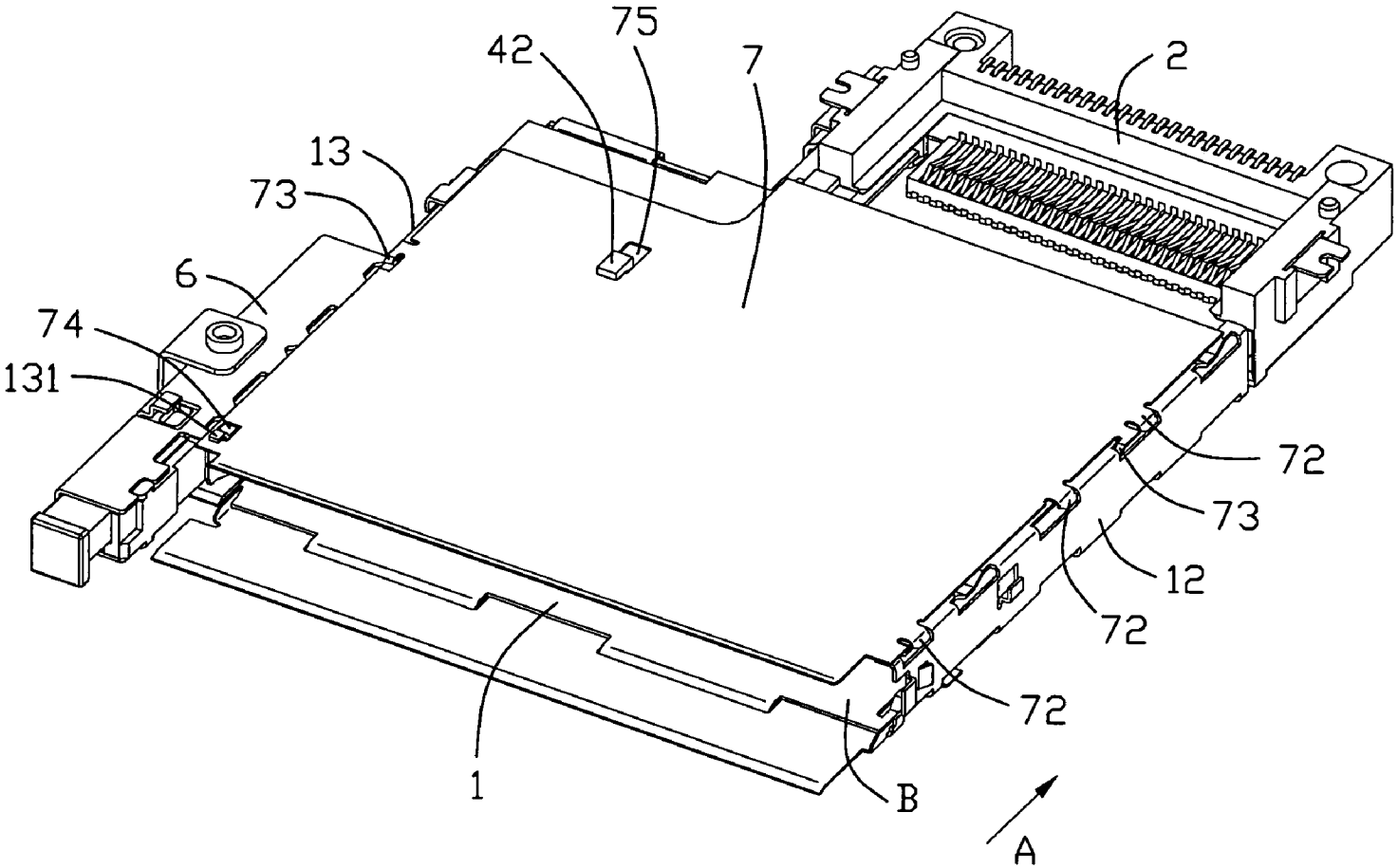
FIG. 2 is a perspective view of a bottom plate removed from the electrical card connector as shown in FIG. 1.

As shown in FIG. 1 and FIG. 2, the shell 1, structured as L-shaped, comprises a first body plate 11, a longer side wall 12, a shorter side wall 13, and a transverse plate 14 relative to a card insertion direction. The side walls 12,13 extend downwardly from the first body plate 11 and then bend inwardly, respectively. Thus, a card room (not labeled) is defined by the shorter side wall 13, the longer wall 12 and the first body plate 11. The card room defines a card insertion opening B and a card insertion direction A. A plurality of locking holes 130 and 120 are defined on the shorter side wall 13 and the longer side wall 12, respectively. Furthermore, a first clasp 131 is formed on the shorter side wall 12 adjacent to the card insertion opening B. On the first body plate 11, a gap 111 (shown in FIG. 5) is formed along a card insertion/ejection direction.

The insulating housing 2 has a tongue plate 22, a plurality of terminal channels 21 going through the tongue plate 22 for retaining the terminals 3. The terminals 3 each has an engaging portion protruding into the card room for contacting electrically with a card.

The guiding plate 4, structured as a triangle type and adapted for guiding a card insertion, is made of plastic material. The guiding plate 4 has a triangular second body plate 41 with a first side edge 43 and a second side edge 44 perpendicular to the first side edge 43. A second clasp 42 is formed on the second body plate 41. In this embodiment, the second body plate 41 and the second clasp 42 are integral.

Figure 3:
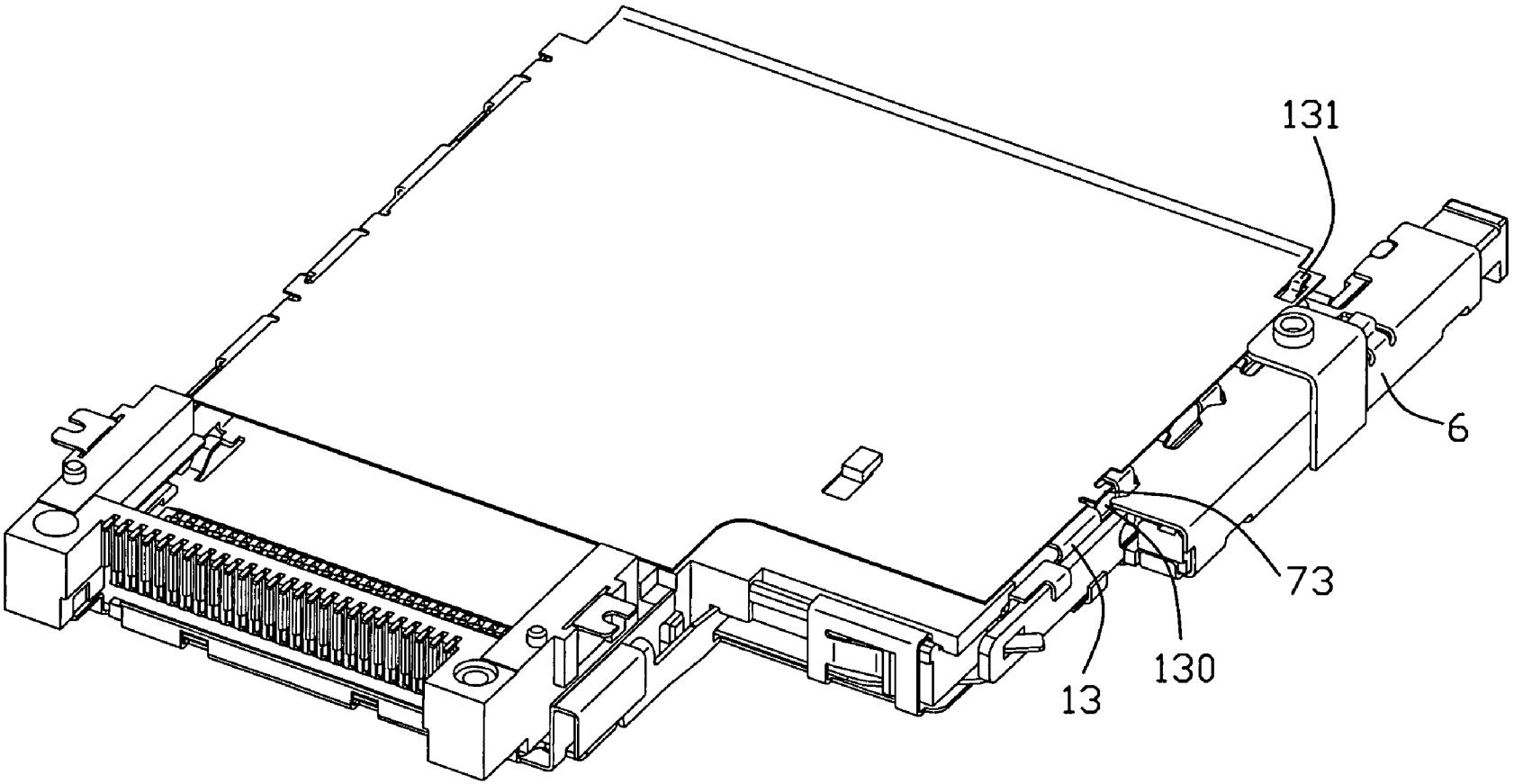
FIG. 3 is a perspective view of the electrical card connector shown in another aspect of FIG. 1.
Figure 4:
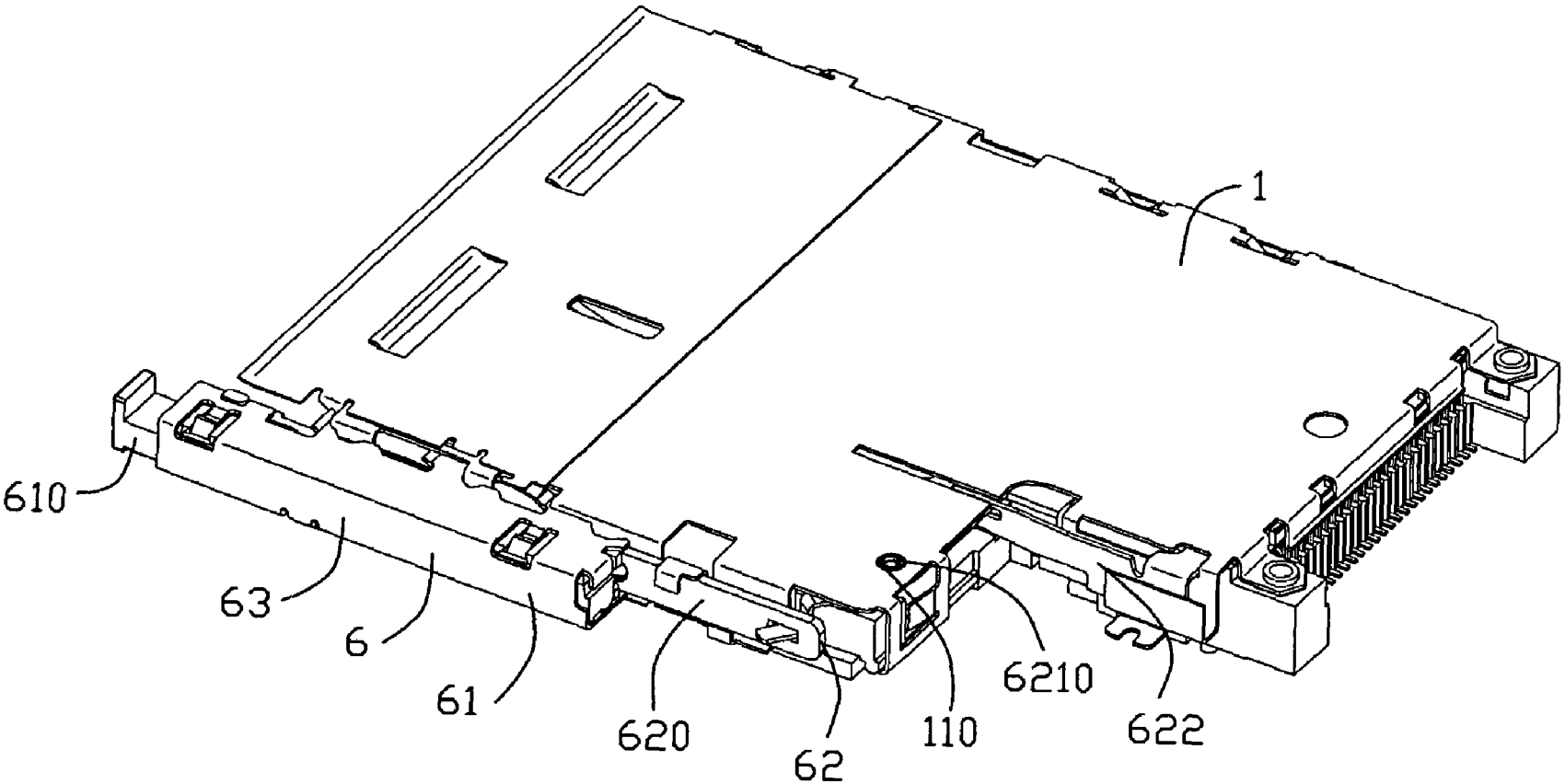
FIG. 4 is a perspective view of the electrical card connector shown in opposite side of FIG. 1.
Figure 5:
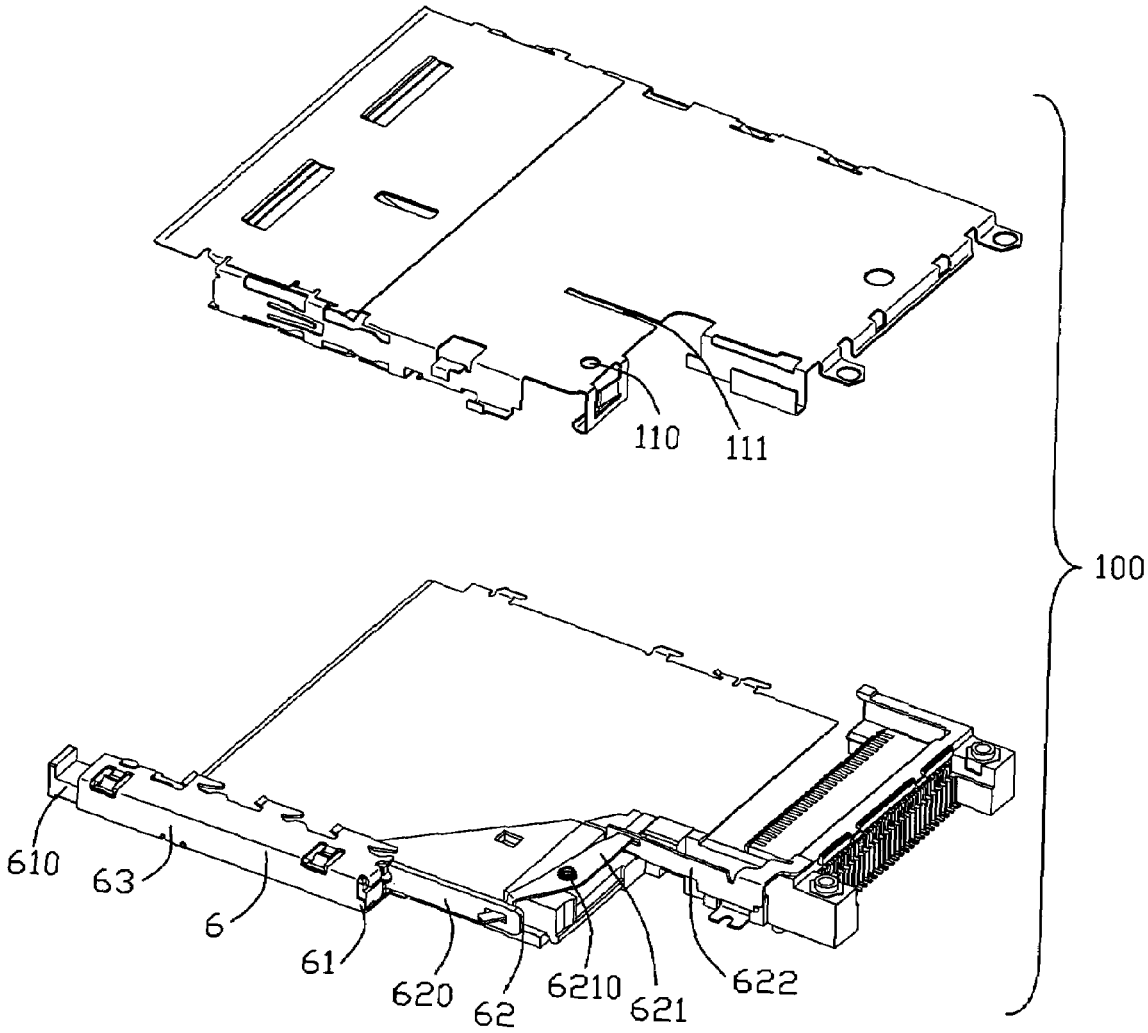
FIG. 5 is a perspective view of the shell removed from the electrical card connector of the present invention.

As shown in FIG. 3 to FIG. 5, the ejecting mechanism 6 for pushing a selected card out of the card room, comprises an ejecting member 62 and an operating member 61. The ejecting member 62 to be engaged with the selected one and moved together with the selected one, comprises a subordinating bar 620, a rotary bar 621 and an ejecting bar 622. The operating member 61 comprises a pushing bar 610, a hearted groove (not shown), an elastic section (not shown) and a slider (not shown). One end of the slider is fastened with the pushing bar 610 and the other end removable is received in the hearted groove. Accordingly, one end of the subordinating bar 620 is interfered with the pushing bar 610, and the other joins with one end of the rotary bar 621. The other end of the rotary bar 621 joins with the ejecting bar 622. Generally, a bracket 63 encloses on the pushing bar 610 for mounting the ejecting mechanism 6 on one side wall 13 of the shell 1.

When the selected card is pushed out by pushing the pushing bar 610, the ejecting mechanism 6 works in this manner that the slider moves in the hearted groove controlling the pushing bar 610 to a desirable position, then the subordinating bar 620 is operated and moves backwardly. Accordingly, the subordinating bar 620 makes one end of the rotary bar 621 move backwardly and the rotary bar 621 rotates around a rotation center 6210 formed thereof to bring the other end connecting with the ejecting bar 622 forwardly. As a result, the ejecting bar 622 is driven forwardly. So the card is ejected.

As shown in FIG. 1, the bottom plate 7 has a flat body 71. According with the structure of the shell 1, the flat body 71 comprises a longer edge 710 and a shorter edge 711. On the longer edge 710, a plurality of tabs 72 are formed extending backwardly for preventing the bottom plate moving forwardly, correspondingly, a tab 73 is formed extending forwardly thereof for preventing the bottom plate moving backwardly. The shorter edge 711 comprises a tab 73 and a first locking hole 74. A second locking hole 75 is defined on the flat body 71 corresponding to the second clasp 42 of the guiding plate 4.

Going with the FIG. 1 to FIG. 5, the relationship of the elements as described above will be illustrated in following segments.

At first, the insulating housing 2 is placed in the card room defined by the shell 1 and opposite to the card insertion opening B. The guiding plate 4 is also located in the card room with the first side edge 43 and the second side edge 44 fastening with the shorter side wall 13 and the transverse plate 14, respectively. The expanding plate 5 is located on the head of the body plate 11 of the shell 1 to expand the body plate 11. Secondly, the bottom plate 7 is mated with the shell by the tabs 72 and 73 on the longer side edge 710 of the bottom plate 7 locking with the corresponding locking holes 120 of the longer side wall 12 of the shell 1, at the same time, the tab 73 on the shorter edge 711 locking with corresponding locking hole 130 of the shorter side wall 13, the first locking hole 74 locking with the first clasp 131. Particularly, the second clasp 42 of the guiding plate locks with the locking hole 74 of the bottom plate 7, allowing the shell 1 and the bottom plate 7 to lock with each other more firmly. Finally, the ejecting mechanism 6 is placed on the shorter side wall 13 of the shell 1 with the ejecting member 622 partially disposed in the gap 111 of the shell 1 and movably with a card insertion or ejection.

In this embodiment, the second clasp is formed on the guiding plate 4, and the corresponding hole 75 is defined on the bottom plate 7. In another embodiment of the present invention, the second clasp 42 can also be formed on the bottom plate 7, and the corresponding hole 75 is defined on the guiding plate 4. In a word, any fastener formed on the guiding plate 4 to mating with another fastener formed on the bottom plate 7 allowing the shell and the bottom plate locking with each other more firmly is suitable in this invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical card connector comprising:

a shell, structured as L-shaped, comprising a shorter side wall and a longer side wall opposite to the shorter side wall and defining a card room for receiving a card;

an insulating housing covered by the shell;

a plurality of terminals retained in the insulating housing;

a triangular guiding plate placed in the card room for guiding a card insertion and having a clasp; and a bottom plate conforming in shape with the shell and placed under and locked with the guiding plate, a hole defined on the bottom plate to lock with the clasp of the guiding plate in such manner that the clasp goes through the hole completely and then the bottom plate moves forwardly until a part of the bottom plate is sandwiched by the clasp and the guiding plate;

wherein an ejecting mechanism is placed on the shorter side wall of the shell;

wherein the ejecting mechanism comprises an ejecting member and an operating member joining movably with the ejecting member, the ejecting member protruding into the card room to engage with an insertion card;

wherein the ejecting mechanism comprises a bracket covering on the operating member.

2. The electrical card connector as claimed in claim 1, wherein a gap is defined on the shell, and the operating member is partially disposed in the gap to slide together with the card inserted or ejected.

3. The electrical card connector as claimed in claim 1, wherein the insulating housing has a of terminal channels for retaining the terminals therein.

4. The electrical card connector as claimed in claim 1, wherein the insulating housing has a tongue plate protruding into yhe card room, the terminal channels extending through the tongue plate.

5. The electrical card connector as claimed in claim 2, wherein the bottom plate comprises a shorter edge and a longer edge locking with corresponding shorter side wall and longer side wall of the shell.

6. The electrical card connector as claimed in claim 5, wherein a plurality of locking holes formed on the side walls of the shell, and a plurality of tabs are formed on the edges of the bottom plate to lock with the locking holes.

7. A card tormentor comprising: an insulating housing defining opposite first and second faces in a vertical direction;

a plurality of conacts disposed in the housing and defining a triangular configuration under a condition that said guiding plate is located around and closer to said first face rather than the second face;

a first metallic shell positioned around the fast face and a second metallic shell positioned around the second face under a condition that said first shell and said second shell cooperate with the housing to commonly define an electronic card receiving face;

complementary interengagement devices are formed on both said guiding plate and said first shell is fasten both together in said vertical direction so as not to allow the first shell to leave away from said card receiving space in said vertical direction;

wherein the second metallic shell, structed as L-shaped, comprising a shorter side wall and a longer side wall opposite to the shorter side wall;

wherein an ejecting mechanism is placed on the shorter side wall of the second metallic shell;

wherein the ejecting mechanism comprises an electing member and an operating member joining movably with the ejecting member, the ejecting member protuding into the electronic card receiving space with an insertion electronic card;

wherein the ejecting mechanism comprises a bracket covering on the operating member.

8. The card connector as claimed in claim 7, wherein said first shell intimately contacts the triangular configuration of said guiding plate in said vertical direction and faces toward the card receiving space.

* * * * *